US010434365B2

(12) United States Patent
Mack

(10) Patent No.: US 10,434,365 B2
(45) Date of Patent: Oct. 8, 2019

(54) DEVICE AND METHOD FOR STRENGTHENING AND REHABILITATING THE ANKLE JOINT

(71) Applicant: PRISM ALLIANCE GROUP INC., Novi, MI (US)

(72) Inventor: Anthony Mack, Sartell, MN (US)

(73) Assignee: Secure linx Corporation, Novi, MI (US)

( * ) Notice: Subject to any disclaimer, the term of this patent is extended or adjusted under 35 U.S.C. 154(b) by 0 days.

(21) Appl. No.: 15/335,169

(22) Filed: Oct. 26, 2016

(65) Prior Publication Data

US 2017/0043211 A1 Feb. 16, 2017

Related U.S. Application Data

(63) Continuation-in-part of application No. 13/795,774, filed on Mar. 12, 2013, now abandoned.
(Continued)

(51) Int. Cl.
*A63B 21/00* (2006.01)
*A63B 21/04* (2006.01)
(Continued)

(52) U.S. Cl.
CPC ..... *A63B 23/08* (2013.01); *A63B 21/00069* (2013.01); *A63B 21/0414* (2013.01);
(Continued)

(58) Field of Classification Search
CPC .... A63B 5/00; A63B 5/08; A63B 5/10; A63B 5/11; A63B 5/12; A63B 5/16; A63B 2005/085; A63B 6/00; A63B 21/00058; A63B 21/00061; A63B 21/00065; A63B 21/00069; A63B 21/00072; A63B 21/00076; A63B 21/00178;
(Continued)

(56) References Cited

U.S. PATENT DOCUMENTS 1,117,796 A * 11/1914 Coulter ..... A63B 21/023 482/123
3,020,046 A * 2/1962 Hotas ..... A63B 22/16 482/79
(Continued)

*Primary Examiner* — Gary D Urbiel Goldner
(74) *Attorney, Agent, or Firm* — Thomas P. Heed; HeedLawGroup

(57) ABSTRACT

The present invention comprises a device for strengthening, improving range of motion and/or improving flexibility in ankle joints and/or rehabilitating injured ankle joints. The device comprises a structure or frame, at least one resistance mechanism connected to the structure or frame and a support platform connected to the at least one resistance mechanism for supporting a patient's foot. Rotating, flexing, inverting and/or everting the patient's foot connected to the ankle of interest, which results in pressure applied to the support platform by the patient's foot, increases and/or decreases tension in the at least one resistance mechanism. A variety of stretches and/or strengthening and/or rehabilitating exercises may be performed with the device. The support platform is suspended within the frame on the at least one resistance mechanism and, as a result, the support platform may be rotated, flexed, inverted and/or everted in an infinite number of directions.

14 Claims, 9 Drawing Sheets

Related U.S. Application Data

(60) Provisional application No. 61/693,600, filed on Aug. 27, 2012.

(51) Int. Cl.

| | |
|---|---|
| ***A63B 22/00*** | (2006.01) |
| ***A63B 22/18*** | (2006.01) |
| ***A63B 23/08*** | (2006.01) |
| ***A63B 24/00*** | (2006.01) |
| ***A63B 71/06*** | (2006.01) |
| ***A63B 21/055*** | (2006.01) |
| ***A63B 23/035*** | (2006.01) |

(52) U.S. Cl.

CPC ..... *A63B 21/0428* (2013.01); *A63B 21/0552* (2013.01); *A63B 21/4034* (2015.10); *A63B 23/03508* (2013.01); *A63B 22/18* (2013.01); *A63B 24/0062* (2013.01); *A63B 71/0619* (2013.01); *A63B 2022/0094* (2013.01); *A63B 2022/185* (2013.01); *A63B 2071/0694* (2013.01); *A63B 2210/50* (2013.01); *A63B 2220/51* (2013.01)

(58) Field of Classification Search

CPC ..... A63B 21/00181; A63B 21/00185; A63B 21/002; A63B 21/0023; A63B 21/02; A63B 21/023; A63B 21/025; A63B 21/026; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/16; A63B 21/169; A63B 21/4011; A63B 21/4013; A63B 21/4015; A63B 21/4025; A63B 21/4027; A63B 21/4033; A63B 21/4034; A63B 21/4037; A63B 21/4039; A63B 21/4045; A63B 21/4047; A63B 21/4049; A63B 22/0046; A63B 22/18; A63B 2022/0094; A63B 2022/0097; A63B 2022/185; A63B 23/035; A63B 23/03508; A63B 23/08; A63B 23/085; A63B 24/0021; A63B 24/0062; A63B 2024/0025; A63B 2024/0028; A63B 2024/0037; A63B 71/0054; A63B 71/0619; A63B 2071/0063; A63B 2071/0072; A63B 2071/0694; A63B 2208/0209; A63B 2210/00; A63B 2210/50; A63B 2220/50; A63B 2220/51; A63B 2220/80; A63B 2220/803; A63B 2220/805; A63B 2220/83; A63B 2220/833; A63B 2225/09; A63B 2225/093

See application file for complete search history.

(56) References Cited

U.S. PATENT DOCUMENTS 3,356,366 A * 12/1967 Barthel ..... A63B 5/11 182/139
4,569,515 A * 2/1986 Gordon ..... A63B 5/11 273/401
4,703,928 A * 11/1987 Escher ..... A63B 21/0004 482/110
4,707,934 A * 11/1987 Hart ..... A63B 25/10 36/132
4,876,804 A * 10/1989 Hart ..... A63B 25/10 36/7.8
5,016,874 A * 5/1991 Boardman ..... A63B 21/055 482/122
5,035,421 A * 7/1991 Scheller ..... A63B 21/023 482/130
5,704,882 A * 1/1998 Coates ..... A47C 3/0252 297/273
5,749,668 A * 5/1998 McIlvain ..... A63B 21/154 482/79
5,857,944 A * 1/1999 Cone ..... A47D 13/043 297/274
5,925,000 A * 7/1999 Marciniak ..... A43B 7/24 482/8
5,941,802 A * 8/1999 Kiser ..... A63B 1/00 482/129
5,947,875 A * 9/1999 Cone ..... A47D 13/043 482/143
5,957,816 A * 9/1999 Staffa ..... A63B 21/154 482/126
6,053,845 A * 4/2000 Publicover ..... A63B 5/11 482/27
6,063,013 A * 5/2000 Vathappallil ..... A63B 21/023 482/120
6,071,213 A * 6/2000 Raasch ..... A63B 5/11 220/9.4
6,217,488 B1 * 4/2001 Bernardson ..... A63B 22/16 482/79
6,277,057 B1 * 8/2001 Hayden ..... A63B 21/0083 482/79
6,283,897 B1 * 9/2001 Patton ..... A63B 21/0004 482/124
6,599,198 B2 * 7/2003 Ettenhofer ..... A63B 69/04 434/247
6,676,579 B1 * 1/2004 Lin ..... A63B 22/0012 482/146
6,821,235 B1 * 11/2004 Johnson ..... A63B 21/0552 482/146
6,942,487 B2 * 9/2005 Corbalis ..... A63B 69/0093 280/818
7,150,704 B2 * 12/2006 Schaeffer ..... A63B 22/00 482/148
7,192,410 B1 * 3/2007 Rodgers ..... A61F 5/00 482/79
7,309,303 B1 * 12/2007 Proctor ..... A63B 3/00 482/121
7,322,914 B1 * 1/2008 Vittone ..... A63B 21/055 482/146
7,335,167 B1 * 2/2008 Mummy ..... A61B 5/1071 33/471
7,381,168 B2 * 6/2008 Bowser ..... A63B 21/04 482/121
7,458,924 B1 * 12/2008 Anderson ..... A63B 1/00 482/148
7,462,142 B1 * 12/2008 Gordon ..... A63B 6/00 482/142
7,481,751 B1 * 1/2009 Arnold ..... A63B 21/023 482/121
7,666,126 B2 * 2/2010 Rempe ..... A63B 22/18 482/121
7,758,471 B2 * 7/2010 Nelson ..... A63B 5/11 482/27
7,762,927 B1 * 7/2010 Gordon ..... A63B 5/11 482/27
D631,107 S * 1/2011 Gillis ..... D21/685
7,935,026 B2 * 5/2011 McSorley ..... A63B 23/16 482/44
8,083,654 B1 * 12/2011 MacDonald ..... A63B 21/04 482/121
8,202,205 B2 * 6/2012 Reade ..... A63B 21/0552 482/121
8,206,266 B2 * 6/2012 Hall ..... A63B 5/11 482/1
8,360,940 B2 * 1/2013 Kole ..... A63B 21/028 482/121
8,403,817 B2 * 3/2013 Ferguson ..... A63B 21/4025 482/74

(56) References Cited

U.S. PATENT DOCUMENTS 8,585,558 B2 * 11/2013 Chen ..... A63B 5/11 482/27
8,657,696 B1 * 2/2014 Gurley ..... A63B 5/11 472/92
8,734,297 B2 * 5/2014 Chen ..... A63B 5/11 482/27
8,968,110 B2 * 3/2015 Bapst ..... A47D 13/107 472/103
9,630,040 B1 * 4/2017 Louis ..... A63B 5/11
2002/0137598 A1 * 9/2002 Publicover ..... A63B 5/11 482/27
2004/0009850 A1 * 1/2004 Teff ..... A63B 21/0552 482/79
2004/0121883 A1 * 6/2004 Publicover ..... A63B 5/11 482/29
2005/0107226 A1 * 5/2005 Monda ..... A63B 21/04 482/121
2006/0116242 A1 * 6/2006 Publicover ..... A63B 5/11 482/27
2006/0135320 A1 * 6/2006 Chen ..... A63B 5/11 482/27
2006/0135321 A1 * 6/2006 Chen ..... A63B 5/11 482/27
2007/0004559 A1 * 1/2007 Alexander ..... A63B 5/11 482/27
2007/0004560 A1 * 1/2007 Nelson ..... A63B 5/11 482/29
2008/0076638 A1 * 3/2008 Publicover ..... A63B 5/11 482/27
2008/0269019 A1 * 10/2008 Lovley, II ..... A63B 5/11 482/27
2008/0269021 A1 * 10/2008 Publicover ..... A63B 5/11 482/29
2008/0318744 A1 * 12/2008 Barra ..... A63B 21/0552 482/142
2009/0005187 A1 * 1/2009 Schechter ..... A63B 21/00047 472/134
2009/0270231 A1 * 10/2009 Hall ..... A63B 21/0552 482/79
2010/0279835 A1 * 11/2010 Ozawa ..... A61H 1/0266 482/142
2010/0286575 A1 * 11/2010 Ochi ..... A61H 1/005 601/5
2011/0136597 A1 * 6/2011 Gordon ..... A63B 5/11 473/478
2012/0142500 A1 * 6/2012 Ronan ..... A63B 5/11 482/29
2012/0252644 A1 * 10/2012 Reade ..... A63B 21/0023 482/129
2012/0295763 A1 * 11/2012 Lin ..... A63B 5/11 482/4
2014/0018218 A1 * 1/2014 Chen ..... A63B 22/18 482/146

* cited by examiner

DEVICE AND METHOD FOR STRENGTHENING AND REHABILITATING THE ANKLE JOINT

RELATED APPLICATIONS

This application is a continuation-in-part of application Ser. No. 13/795,774, filed Mar. 12, 2013, and entitled, "Rehabilitation Device for Strengthening and Improving Range of Motion in Joints." This application claims benefit of provisional application 61/693,600, filed Aug. 27, 2012, entitled "Rehabilitation Device for Strengthening and Improving Range of Motion in Joints". Both applications are incorporated herein, by reference.

FIELD OF INVENTION

The invention relates to a device for strengthening and/or improving the range of motion and/or flexibility of a patient's ankle joint. The device may be used to prevent and/or treat ankle injuries. The device facilitates a variety of stretches, strength building exercises and rehabilitating exercises.

BACKGROUND OF INVENTION

Ankle strains and sprains are a common injury. A typical person's, or even a typical athlete's, ankle strength is insufficient for many modern sporting and recreational activities. Sports such as basketball, tennis, football, baseball, and soccer require quick pivots and foot plants, often resulting in ankle strains and sprains. Similarly, many exercises such as biking, hiking, running, and climbing can result in ankle strains and sprains. For teens and young adults, more extreme activities such as skiing and skateboarding can injure the ankle.

Even though ankle injuries are ubiquitous, there are a dearth of devices and methods that are intended to strengthen and/or rehabilitate the ankle. As a result, many people repeatedly injure their ankles and take prolonged periods of time to recover from such injuries.

SUMMARY OF THE INVENTION

This summary is intended to disclose the present invention, a device for strengthening and rehabilitating the ankle joint. The embodiments and descriptions are used to illustrate the invention and its utility, and are not intended to limit the invention or its use.

The present invention comprises a device for strengthening, improving range of motion and/or improving flexibility in ankle joints and/or rehabilitating injured ankle joints. The device comprises structure or frame, at least one resistance mechanism connected to the structure or frame and a substantially planar, rigid support platform connected to the at least one resistance mechanism for supporting the patient's foot. Rotating, flexing, inverting and/or everting the foot connected to the ankle of interest, which results in pressure applied to the substantially planar, rigid support platform by the subject foot, increases and/or decreases the tension in the at least one resistance mechanism. A variety of stretches and/or strengthening and/or rehabilitating exercises may be performed with the device. The substantially planar, rigid support platform is suspended within the frame on the at least one resistance mechanism and, as a result, the substantially planar, rigid support platform may be rotated, flexed, inverted and/or everted in an infinite number of directions.

The figures and the detailed description which follow more particularly exemplify these and other embodiments of the invention.

BRIEF DESCRIPTION OF THE DRAWINGS

The present invention is illustrated with 8 figures on 9 sheets.

Figure 1:
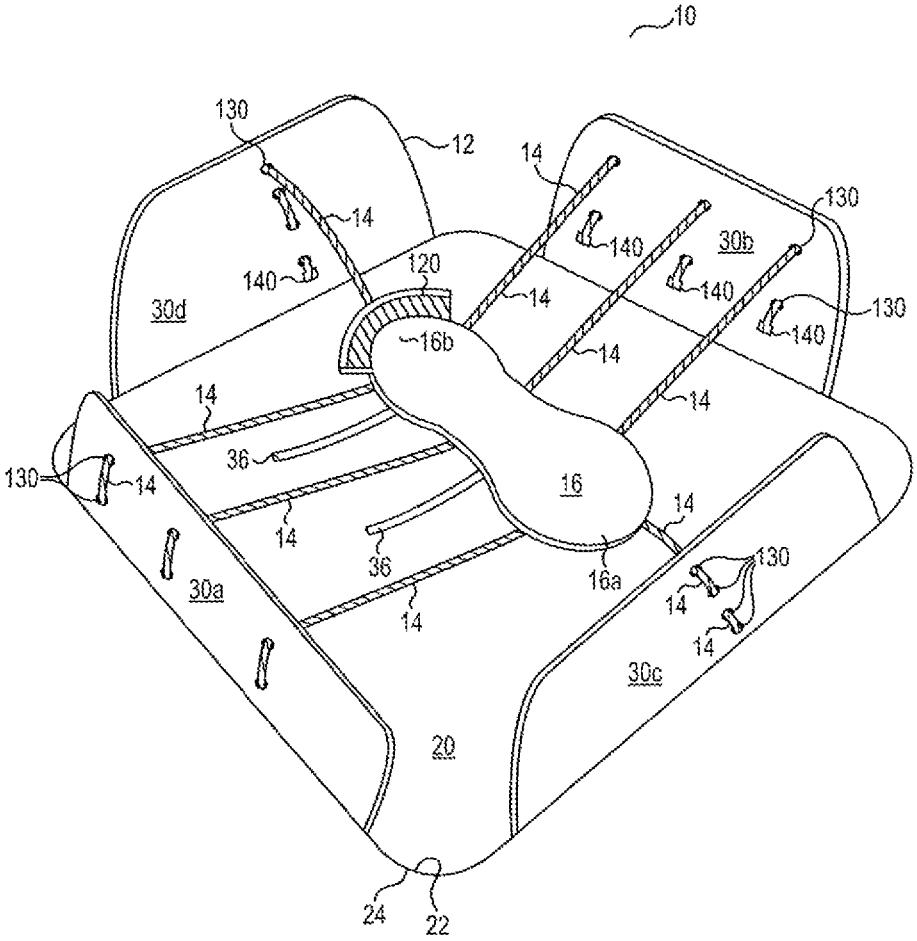
FIG. 1 illustrates a perspective view of one embodiment of the present invention.

The invention may be more completely understood in consideration of the following detailed description of various embodiments of the invention in connection with the accompanying drawings, which are as follows.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE DRAWINGS

The following descriptions are not meant to limit the invention, but rather to add to the summary of invention, and illustrate the present invention, by offering and illustrating various embodiments of the present invention, a device for strengthening and rehabilitating the ankle joint. While embodiments of the invention are illustrated and described, the embodiments herein do not represent all possible forms of the invention. Rather, the descriptions, illustrations, and embodiments are intended to teach and inform without limiting the scope of the invention.

A device 10 for strengthening, improving range of motion and/or flexibility, and/or rehabilitating an injured ankle joint comprises a frame 12, at least one resistance mechanism 14 connected to a frame 12, and a substantially planar, rigid support platform 16 connected to the at least one resistance mechanism 14 for supporting the foot connected to the ankle joint of interest.

The device 10 may be used to prevent an ankle injury by improving the strength, range of motion and/or flexibility of the ankle joint, and muscles, tissues, tendons, etc., facilitating movement of the ankle joint. The device 10 may be further used to rehabilitate an injured ankle joint, e.g., and without limitation, a sprained ankle.

The frame 12, in some embodiments, comprises a base 20 with a first major surface 22 that faces upward and a second major surface 24 that faces downward. Base 20 can be of any suitable shape, but in some embodiments, such as the embodiment shown in FIG. 1, base 20 comprises a rectangular shape. The skilled artisan will readily recognize alternate shapes for the base 20 which will provide equivalent results and function, for example and without limitation, a square. Each of the equivalent base 20 shapes are within the scope of the present invention.

The rigid structure 12 further comprises at least two opposing side walls 30*a*, 30*b* extending upwardly from the base 20, as shown in FIG. 1. In at least the embodiment shown in FIG. 1, the two opposing side walls 30*a*, 30*b* extend upwardly from the first major surface 22 of the base 20 at or substantially near opposite sides. In some embodiments, the two walls 30*a*, 30*b* are generally parallel to one another. In embodiments, such as the embodiment of FIG. 1, two additional opposing walls, a toe wall 30*c*, and a heel wall 30*d* extend upwardly from the first major surface of the base 20. In some embodiments toe and heel walls 30*c*, 30*d* are generally parallel to one another. In the illustrated embodiment, the side walls 30*a*, 30*b* are arranged substantially perpendicularly to the toe and heel walls 30*c*, 30*d*, though other configurations are certainly possible and within the scope of the present invention. In at least one embodiment, the number of opposing walls extending upwardly from the base 20 is equivalent to the number of sides of the base 20. Thus, in the illustrated embodiment, the number of sides of the base 20 is four and the number of opposing walls 30*a*, 30*b*, 30*c* and 30*d* is also four.

Frame 12 may be, as illustrated in FIG. 1, a rigid non-collapsible structure. In alternative embodiments, the frame 12 may comprise sides 26 that are either removeable and/or collapsible to facilitate storage and/or transport by reducing the size and footprint of the disassembled or collapsed frame 12.

Figure 2:
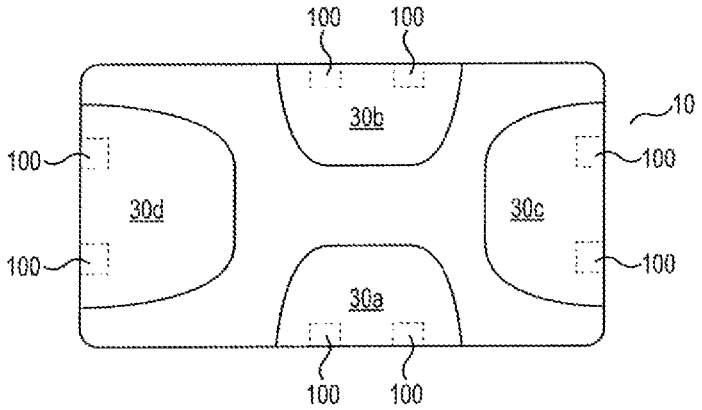
FIG. 2 illustrates a top partial view of one embodiment of the present invention.
Figure 3:
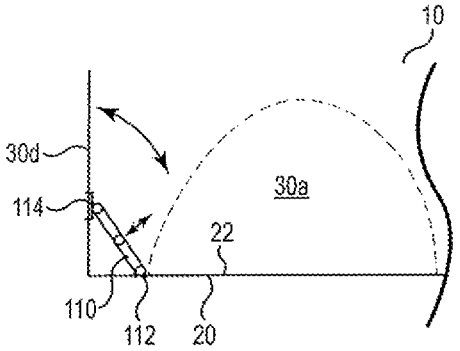
FIG. 3 illustrates a partial cutaway view of one embodiment of the present invention.

FIGS. 2 and 3 illustrate alternate embodiments for collapsible frame 12. FIG. 2 illustrates a top view of device 10 comprising frame 12 having a rectangular shape with four sides and, as in FIG. 1, four opposing walls 30*a*, 30*b*, 30*c*, 30*d*. Each of the opposing walls 30*a*, 30*b*, 30*c*, 30*d* further comprise one, or two or more, hinges 100 attached to the first major surface 22 of base 20 and to the corresponding opposing wall 30*a*, 30*b*, 30*c*, 30*d*. This allows the opposing walls 30*a*, 30*b*, 30*c*, 30*d* to be folded downward toward the first major surface 22 of base 20, thus collapsing the profile of the device 10 for storage and/or transport. The skilled artisan may recognize that one hinge 100 for each opposing wall 30*a*, 30*b*, 30*c*, 30*d* may suffice, or that more two or more hinges 100 may be preferred. Each such configuration is within the scope of the present invention.

According to this alternative embodiment, when the device 10 is required for use, opposing walls 30*a*, 30*b*, 30*c*, 30*d* are rotated on the hinge(s) 100 away from the first major surface 22 of base 20 and locked in place by methods well known to the skilled artisan. In this manner, collapsible walls 30*a*, 30*b*, 30*c*, 30*d* are capable of rotational collapse, wherein the walls lie substantially flat against the first major surface 22 of base 20 and locking deployment, wherein the opposing walls rise at an angle, preferable a right angle though other angles will also work, above the first major surface 22 of base 20.

FIG. 3 illustrates another type of hinging and locking mechanism 110 that may be used to allow collapsible rotation and locking deployment of the collapsible walls 30*a*, 30*b*, 30*c*, 30*d*. Here, mechanism 110 comprises a first end 112 and a second end 114, wherein first end 112 is secured, by fasteners such as for example and without limitation screws or nuts and bolts, to the first major surface 22 of base 20 and second end 114 is secured to the proximate opposing wall, as illustrated in the partial cutaway of FIG. 3, heel wall 30*d* to render heel wall 30*d* in the illustrated deployed locked position. Wall 30*a* is illustrated in the deployed locked position, but in dashed lines. Mechanism 110 further comprises a central pivot 116 allowing rotation of the mechanism's first end 112 and second end 114 around pivot 116. This configuration is well known in the art, being used in many applications including, e.g., card tables and the like. Releasing the central pivot 116 allows the pivot 116 to move, as opposing wall 30*a*, for example, is rotated downward toward the first major surface 22 of base 20. The same process is repeated for each of the remaining opposing walls to achieve the stored, substantially flat, profile for device 10. One or more hinging and locking mechanism 110 may be employed for each collapsible wall 30*a*, 30*b*, 30*c*, 30*d*.

Returning now to FIG. 1, at least one resistance mechanism 14 is connected to each of the opposing walls 30*a*, 30*b*, 30*c* and 30*d*, and the substantially planar, rigid support platform 16 is connected to the at least one resistance mechanism 14. In at least one embodiment, the at least one resistance mechanism 14 is removably and adjustably connected to each of the walls 30*a*, 30*b*, 30*c* and 30*d*. In at least one embodiment, the at least one resistance mechanism is adjustable, as further described supra, thereby allowing the user to adjust, i.e., increase or decrease, the amount of tensional resistance achieved between the subject wall 30*a*, 30*b*, 30*c*, 30*d* and the substantially planar, rigid support platform 16. As the treatment on the joint progresses, more resistance can be added to increase the amount of tension in the device to facilitate gains in strength, flexibility, etc.

As illustrated, the at least one resistance mechanism 14 comprises resistance bands of known tension. The resistance mechanism 14 thus may be stretched or tightened in order to increase the resistance between substantially planar, rigid support platform 16 and the relevant opposing wall to which resistance mechanism 14 is connected. Similarly, resistance mechanism 14 may be loosened in order to decrease the resistance between substantially planar, rigid support platform 16 and the relevant opposing wall to which resistance mechanism 14 is connected. The resistance mechanism 14 may comprise color schemes to indicate relative tensional resistance to aid in quickly setting up the device 10. For example, lighter duty resistance mechanisms 14 may be desired for younger patients or the elderly. These lighter duty resistance mechanisms may comprise a certain identifying color, e.g., green. Medium duty resistance mechanisms 14 may comprise a different color scheme, e.g., purple. Heavy duty resistance mechanisms 14 for advance work may comprise a still different color scheme, e.g., red.

In addition to varying degrees of resistance capability in the resistance mechanisms 14, the resistance of a given resistance mechanism, e.g., a resistance band, may be modified by loosening or tightening the mechanism 14. Markings may be placed on resistance mechanisms 14 to indicate general resistance levels on the individual mechanisms 14. This will aid in accuracy and precision in training resistance levels and help in documenting the progress of the patient as treatment progresses.

In at least the embodiment shown in FIG. 1, the at least one resistance mechanism 14 comprises at least one resistance mechanism 14 connected to the opposing toe wall 30*c* and at least one resistance mechanism 14 connected to the opposing heel wall 30*d*. Further, at least two resistance mechanisms 14 may be connected to side opposing wall 30*a* as well as to side opposing wall 30*b*. These resistance mechanisms 14 are connected at a first end to substantially planar, rigid support platform 16 and, at a second end, to the relevant opposing wall 30*a*, 30*b*, 30*c*, 30*d*. As illustrated, three resistance mechanisms 14 are connected at the first end to substantially planar, rigid support platform 16 and at the second end to each side opposing wall 30*a*, 30*b*.

The skilled artisan will now readily recognize an alternative number of resistance mechanisms 14 to utilize for connecting and suspending the substantially planar, rigid support platform 16 in the described manner, each equivalent alternative being within the scope of the current invention.

Figure 4:
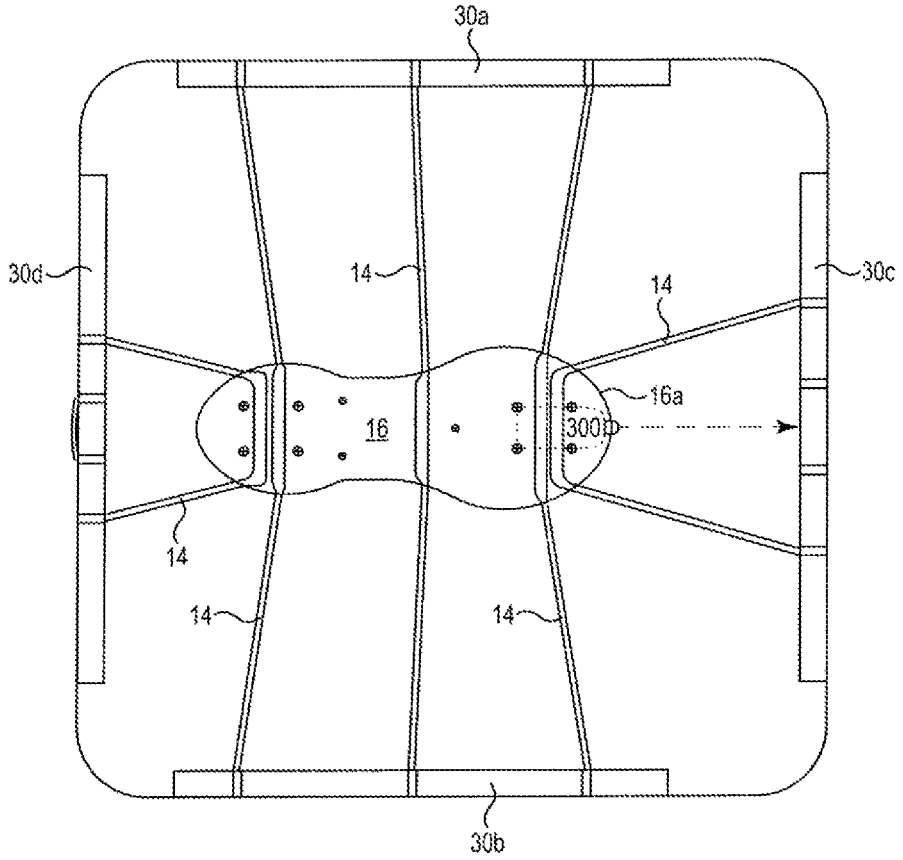
FIG. 4 illustrates a bottom cutaway view of one embodiment of the present invention.

Alternatively, as shown in FIG. 4, a bottom cutaway view through base 20, the resistance mechanisms 14 may be molded or otherwise fixed to the underside of the substantially planar, rigid support platform 16 and further adjustably and releasably attached to the relevant walls 30*a*, 30*b*, 30*c*, 30*d*.

With this arrangement and system, substantially planar, rigid support platform is suspended by the resistance mechanisms 14 above the first major surface 22 of base 20.

In at least one embodiment, the substantially planar, rigid support platform 16 is attached to the first end of resistance mechanism 14 and suspended between the walls 30*a*, 30*b*, 30*c*, 30*d*. In at least one embodiment, the substantially planar, rigid support platform 16 has a toe end 16*a* and a heel end 16*b* opposite the toe end. In some embodiments, the substantially planar, rigid support platform 16 may be ergonomically configured. The substantially planar, rigid support platform may include straps or other retaining devices 36 to keep the body part in a desired position relative to the substantially planar, rigid support platform. The substantially planar, rigid support platform 16 may further comprise a heel support 120 for positioning foot on the substantially planar, rigid support platform 16 and providing placement fixation on substantially planar, rigid support platform 16.

Resistance mechanisms 14 are connected to opposing walls 30*a*, 30*b*, 30*c*, 30*d* by apertures 130 therethrough. As illustrated in FIG. 1, toe and the opposing heel walls 30*c*, 30*d* each comprise a substantially vertical series of four apertures 130. The resistance mechanisms 14 are threaded through the apertures 130. If a change in resistance is desired for resistance mechanisms 14, they may be repositioned in the apertures 130 to either tighten or loosen the resistance mechanism 14 between substantially planar, rigid support platform 16 and walls 30*c*, 30*d*. Equivalent aperture 130 patterns will reveal themselves to the skilled artisan, each of which is within the scope of the present invention.

Opposing side walls 30*a*, 30*b* of FIG. 1 provide three pairs of apertures 130, wherein the pairs are each arranged substantially in a vertical configuration. This allows securing, tightening and/or loosening of each of the resistance mechanisms 14 connected between the substantially planar, rigid support platform 16 and walls 30*a*, 30*b*. Again, equivalent aperture 130 patterns will reveal themselves to the skilled artisan, each of which is within the scope of the present invention.

Figure 5A:
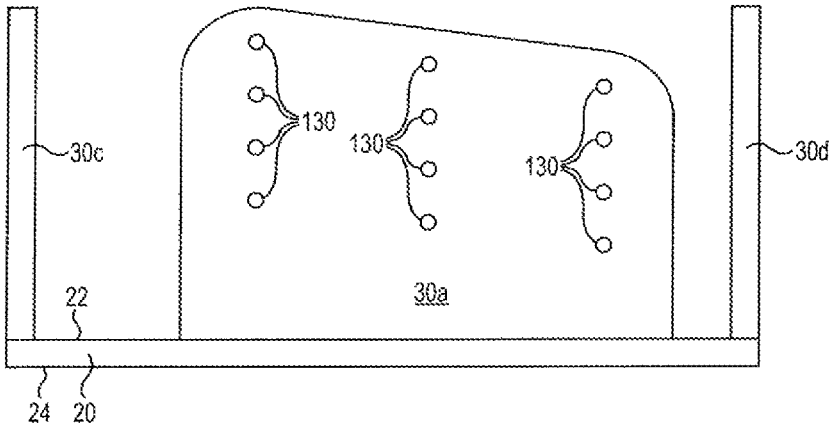
FIGS. 5A and 5B illustrate side views of one embodiment of the present invention.
Figure 6A:
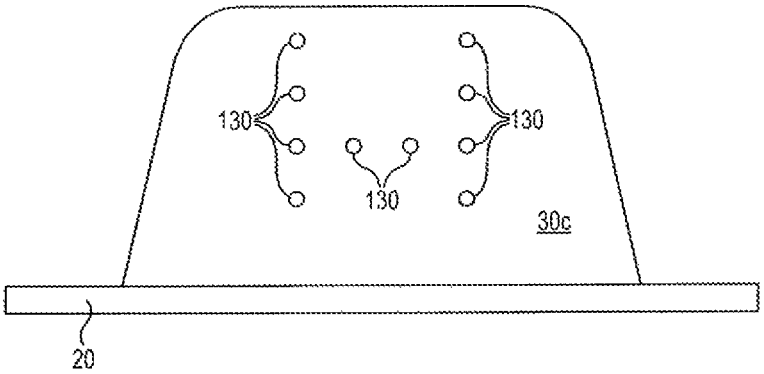
FIGS. 6A and 6B illustrate front and rear views, respectively, of one embodiment of the present invention.
Figure 6B:
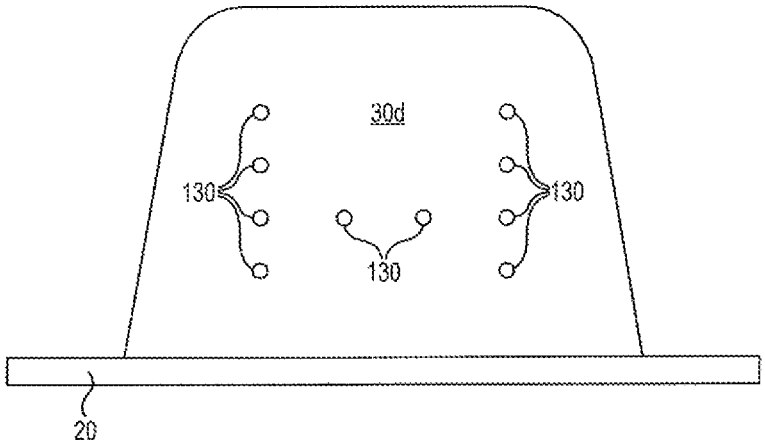

For example, FIGS. 5A and 58 illustrate side opposing walls 30*a*, 30*b*, respectively. In this embodiment, a pattern of three sets of four vertically arranged apertures 130 are provided. And, in the embodiment of FIGS. 6A and 68, two sets of four vertically arranged apertures 130 are illustrated through the toe and heel walls, respectively, with two apertures 130 disposed therebetween.

In certain embodiments, e.g., that of FIG. 1, the resistance mechanisms 14 may be positioned, then essentially tied off with a knot 140 which is larger in diameter than aperture 130 as is well known in the art. Knot 140 may be undone in order to reposition resistance mechanism 14, then re-knotted to secure resistance mechanism in its new position.

Alternatively, instead of knot 140, clamps or the equivalent may be engaged on the resistance mechanisms 14, wherein the clamps are located on the outer surface of the frame and are larger than the aperture 130 so that the clamps are prevented from moving through the aperture 130 when resistance is applied by the clamped resistance mechanisms 14. In this alternative embodiment, the clamps may be easily released allowing the user to either tighten or loosen the resistance mechanism 14 and then re-clamped when the desired resistance is achieved.

Figure 7:
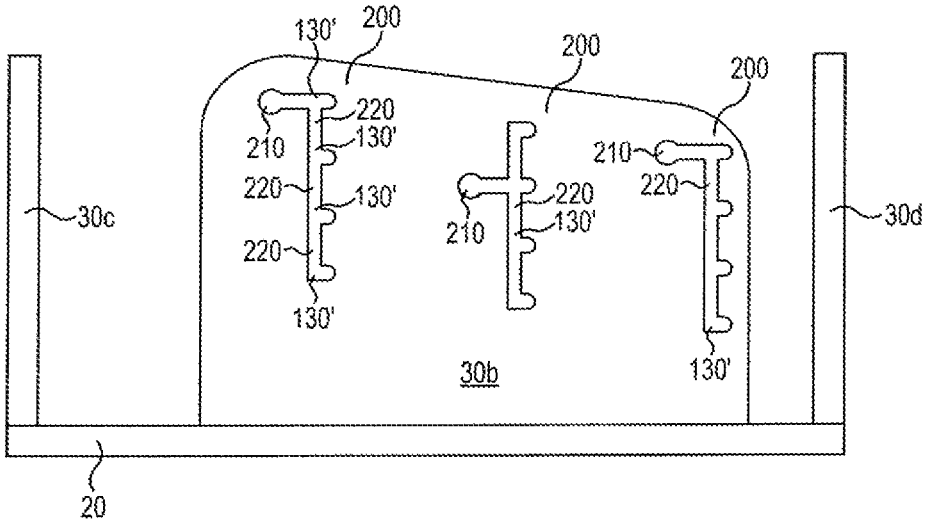
FIG. 7 illustrates a side view of one embodiment of the present invention.

FIG. 7 illustrates an alternative repositioning key mechanism for opposing wall 30*b*. Here, at least one key mechanism 200 is provided. Key mechanism comprises at least one aperture 130', wherein the at least one aperture 130' receives the resistance mechanism 14 for securing therein as described above in connection with FIG. 1 et seq. At least one access aperture 210 is in operative communication with the at least one aperture 130'. At least one access aperture 210 comprises an aperture size that is larger than the at least one aperture 130', wherein the aperture size of the at least one access aperture 210 is sufficiently large to accommodate the resistance mechanism's knot 140 or the alternative releasable clamp therethrough. This allows the resistance mechanism 14 to be readily and easily positioned, then slid into aperture 130' where resistance mechanism 14 is secured by knot 140 or clamp.

As illustrated in FIG. 7, three key mechanisms 200 are provided, wherein each key mechanism 200 comprises four apertures 130' in substantially vertical alignment. Each of the four apertures 130' are in operative communication with the adjacent aperture(s) 130' by a channel 220 which allows sliding movement and repositioning of the resistance mechanisms 14 therethrough, with subsequent securement of the repositioned resistance mechanism 14 in one of the apertures 130'. Each key mechanism 200 further comprises at least one access aperture 210. In each of the three illustrated key mechanisms 200, the access aperture 210 is illustrated in a different position relative to the apertures 130'. Thus, a single access aperture 210 may be used for the individual key mechanisms 200. Alternatively, more than one access aperture 210 may be used for individual key mechanisms. A preferred embodiment may comprise having one access aperture 210 for each of the at least one apertures 130' in each key mechanism. This arrangement allows the operator or user to easily position or reposition resistance mechanisms 14 within the key mechanism 200 without unknotting or otherwise undoing the securing mechanism used to secure the resistance mechanism 14 with aperture 130'.

Figure 8:
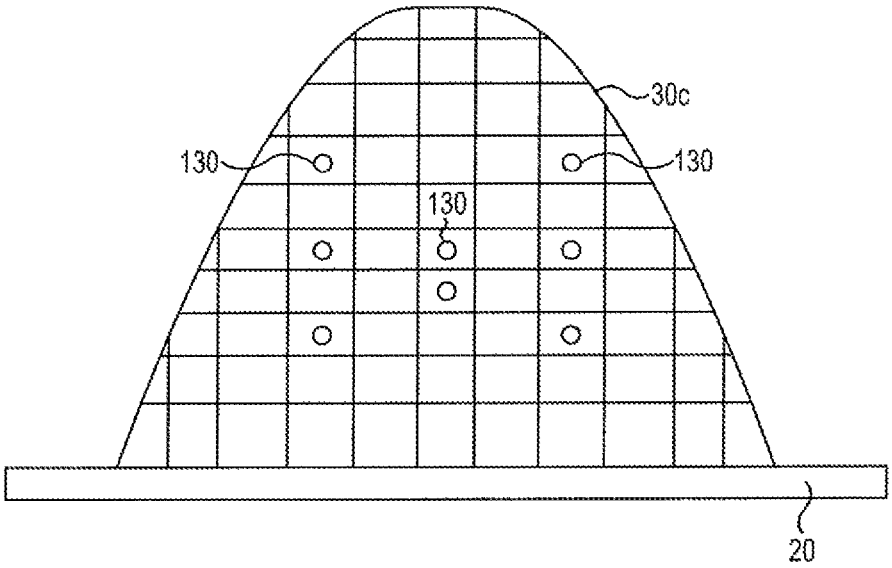
FIG. 8 illustrates a partial cutaway view of one embodiment of the present invention.

Returning now to FIG. 4, a visible light emitting device 300 may be disposed on the underside of the substantially planar, rigid support platform 16 which is capable of emitting light in a line directed toward at least one of the walls 30*a*, 30*b*, 30*c*, 30*d*. The contact point of the light with the wall allows the user, and/or healthcare provider and/or trainer, to determine how much rotation, flexion, eversion etc., that the substantially planar, rigid support platform 16 is undergoing. This also aids in tracking progress of the training and/or treatment over time. To aid in this tracking, a grid of vertical and horizontal lines may be provided on at least one of the walls 30*a*, 30*b*, 30*c*, 30*d*, preferably the wall that is receiving the emitted light beam from the light emitting device 300. Thus, the movement of the light along the grid may be used to determine relative motion, flexibility, etc., during a session as well as track progress over multiple sessions. The grid may be further numbered to facilitate ascertaining reference points, e.g., by identifying numbered cells or intersection points of the grid lines. The grid may be permanently affixed to the subject wall 30*a*, 30*b*, 30*c*, 30*d* or a removable grid may be used that may facilitate note taking and removal after the session is complete and placed in the patient's records for later review. This grid is best illustrated in FIG. 8.

A preferred mounting location for light emitting device 300 is on the toe area 16*a* of substantially planar, rigid support platform 16. This focuses the light beam on the toe wall 30*c* whereupon the grid described above may be disposed.

Rehabilitation device 10 has an initial state and at least one active state. When a person places a body part such as a hand or foot onto the substantially planar, rigid support platform without any weight, the device is in the initial state. When the person rotates the injured joint within the device, the device is in an active state where tension from the resistance bands increases depending on the movement of the injured joint. For example, ankle joints can be worked in the sagittal plane (dorsiflexion, plantarflexion), frontal plane (inversion, eversion) and the horizontal plane (abduction, adduction) or motions can be combined to work more function tri-plane motions of the foot for pronation (dorsiflexion, abduction, eversion) and supination (plantarflexion, adduction, inversion). The resistances bands can be adjusted at any level to modify the specific amount of tension the patient or caregiver needs for the targeted goal of rehabilitation. All of the ankle planes can be performed with any specific thickness of band and the amount of tension can be adjusted to the band. The lever arm of the resistance bands can be lengthened or shortened to allow it to be closer to the axis of rotation.

In addition, the resistance mechanisms 14 may be positioned in apertures 30 or 130' so that the resistance mechanisms 14 for opposing side walls 30*a*, 30*b* are substantially at the same height, rendering the substantially planar, rigid support platform 16 in an attitude that is substantially flat. In other cases, the substantially planar, rigid support platform 16 may be presented to the patient with an attitude or positioning that is tilted in one direction, e.g., with an inversion or an eversion attitude. This may be achieved by lowering the resistance mechanism 14 positioning and height on one of the side walls, 30*a*, 30*b*, by using a lower set of apertures 130, 130', while maintaining the resistance mechanisms 14 position and height on the other side wall. This causes the substantially planar, rigid support platform 16 to take on tilted position and allows the user to focus on one particular side or area of the ankle.

This device allows the patient and caregiver a safe, controlled environment for tissue healing of the foot and ankle. Muscles, tendons, ligaments, capsules and cartilage of the knee, lower leg, ankle and foot can be rehabilitated for various diagnosed injuries or impairments. Muscles and tendons of the anterior lower leg superficial to deep include: tibialis anterior, extensor digitorum longus, extensor hallusis longus, and fibularis tertius. The lateral compartment is composed of the fibularis longus and fibularis brevis. Muscles of the posterior lower leg include: gastrocnemius, soleus, plantaris, popliteus, flexor hallucis longus, flexor digitorum longus, and tibialis posterior.

Common ligaments that will benefit from applied modified tension include: anterior inferior tibiofibular ligament, anterior talofibular ligament, calcaneofibular ligament, deltoid ligament and the plantar fascia.

Whatever the desired strengthening and/or rehabilitation goal, the patient and caregiver have many options when applying exercise. The device will improve coordination, increase muscle recruitment, improve range of motion, decrease edema, allow for safe tissue repair, inhibit pain, improve circulation, improve endurance, increase strength and improve balance.

The device will also assist in the stimulation of cellular metabolism for the production of type 1 collagen and glycosaminoglycan. This new tissue will assist in repairing damaged tissue and increase the tensile properties required by every day function tasks. The device is easily adjustable to modify tension to allow the correct exercise dosage. This will allow the correct healing to take place. All muscles, tendons, ligaments, capsules, cartilage of the ankle and foot will be allowed to start healing with low resistance repetitive motion around a normal physiological axis. In some embodiments, the device can be used to assist in neurological adaptation and nerve stimulation.

In some embodiments, at least the base 20 comprises a suitable material or surface features that allow for increased stability and prevent unintended movement of the base. In at least one embodiment, the second surface 24 of the base comprises a tacky layer of material, a rubberized surface, and/or a plurality of surface features that prevent unintended movement of the base. In some embodiments, the base 20 is permanently or removably fixed to another structure, such as the floor or a weight bench.

Figure 5B:
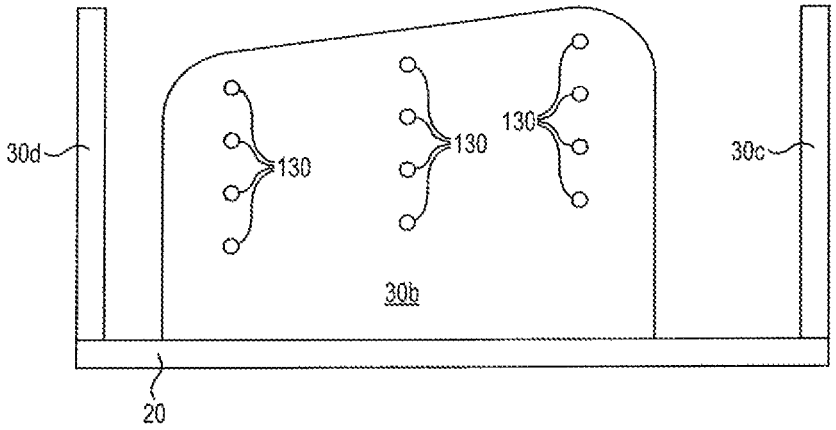

Although all four walls 30*a*, 30*b*, 30*c*, 30*d* are the same height in FIG. 1, in some embodiments, the walls may have different heights. For instance, where the device is used for ankle joints, wall 30*b* at the toe end of the substantially planar, rigid support platform 16 may have a greater height than wall 30*a* at the heel end of the substantially planar, rigid support platform 16. The different heights allow the foot to be placed on substantially planar, rigid support platform 16 at a more comfortable angle. This is best illustrated in FIGS. 5A and 5B.

In some embodiments, the at least one resistance mechanism includes a strain gauge or other suitable measuring device that measures the amount of tension in the at least one resistance mechanism. In some embodiments, an analog or digital indicator of the tension is mounted on the frame 12. In some embodiments, the analog or digital indicator is in communication with a strain gauge. The digital indicator helps the patient and/or a caregiver to determine (and record) the progress of the injured joint as well as providing specific targets for the current and upcoming therapeutic sessions.

The substantially planar, rigid support platform 16 can be fabricated from a wide variety of durable, structural materials, such as wood, steel, aluminum, zinc, magnesium, poly(methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE"). Likewise, the base 20 and the frame 12 can be fabricated from a wide variety of durable, structural materials, such as such as wood, steel, aluminum, zinc, magnesium, poly(methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE").

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

I claim:

1. A device for strengthening and rehabilitating an ankle joint of a user, the device comprising:

a frame comprising a base, at least two opposing side walls, a toe wall, and a heel wall;

wherein the base has a first major surface;

wherein the at least two opposing side walls extend upwardly from the base and comprise a first wall and a second wall opposite and parallel to the first wall; wherein the toe wall extends upwardly from the base;

wherein the heel wall extends upwardly from the base and is opposite and parallel the toe wall;

a plurality of elastic resistance elements; and a substantially planar, rigid support platform, sized and configured for receiving and supporting a foot of the user thereon, the substantially planar, rigid support platform comprising a toe end, oriented to be closest to the toe wall, and a heel end opposite the toe end, oriented to be closest to the heel wall, wherein at least one of the plurality of elastic resistance elements adjustably and releasably attaches the heel end to the heel wall, wherein a different at least one of the plurality of elastic resistance elements adjustably and releasably attaches the toe end to the toe wall, and wherein another different at least one of the plurality of elastic resistance elements adjustably and releasably attaches to the first wall, the substantially planar, rigid support platform, and the second wall; and wherein the first wall, the second wall, the toe wall, and the heel wall can each rotate about a hinge attaching each respective wall to the base.

2. The device of claim 1, further comprising at least one aperture through each of the first wall, the second wall, the toe wall and the heel wall, and whereby the respective at least one of the plurality of elastic resistance elements are respectively releasably and adjustably secured.

3. The device of claim 2 wherein a force required to move the substantially planar, rigid support platform can be increased by detaching the respective at least one of the plurality of elastic resistance elements from a respective at least one aperture, and then stretching and attaching the respective at least one of the plurality of elastic resistance elements to a different at least one aperture further disposed from the substantially planar, rigid support platform ("tightening"), and wherein the force required to move the substantially planar, rigid support platform can be decreased by detaching the respective at least one of the plurality of elastic resistance elements from the respective at least one aperture, and then loosening and attaching the respective at least one of the plurality of elastic resistance elements to another different at least one aperture more closely disposed to the substantially planar, rigid support platform ("loosening").

4. The device of claim 3 wherein the force required to move the substantially planar, rigid support platform can be varied by at least one of the following actions: connecting another respective elastic resistance element between the substantially planar, rigid support platform and the respective walls, removing a respective at least one of the plurality of elastic resistance elements which connect the substantially planar, rigid support platform to the respective walls, tightening the respective at least one of the plurality of elastic resistance elements, or loosening the respective at least one of the plurality of elastic resistance elements.

5. The device of claim 3, further comprising a grid disposed on at least one of the first and second walls, the toe wall and the heel wall, said grid providing guidance for tightening and loosening the plurality of elastic resistance elements.

6. The device of claim 4, wherein the substantially planar, rigid support platform is configured to resist the user's foot when the user attempts to move the substantially planar, rigid support platform with the user's foot.

7. The device of claim 1, wherein the first wall, the second wall, the toe wall, and the heel wall are permanently and durably fixed to the base.

8. The device of claim 1, wherein the first wall, second wall, the toe wall and the heel wall can be detached from the base.

9. The device of claim 1, further comprising a means for tracking the movement of the substantially planar, rigid support platform.

10. The device of claim 9, wherein the tracking means is comprised of at least one light-emitting diode.

11. The device of claim 1, wherein the substantially planar, rigid support platform is fabricated from at least one of wood, steel, aluminum, zinc, magnesium, poly(methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE").

12. The device of claim 1, wherein the frame is fabricated from at least one of wood, steel, aluminum, zinc, magnesium, poly(methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE").

13. The device of claim 1, wherein the base is fabricated from at least one of wood, steel, aluminum, zinc, magnesium, poly(methyl-methacrylate) ("PMMA"), polycarbonate ("PC"), acrylonitrile butadiene styrene ("ABS"), polypropylene ("PP"), high-density polyethylene ("HDPE"), and low-density polyethylene ("LDPE").

14. A method for strengthening and/or rehabilitating an ankle joint of a user, the method comprising:

providing a frame comprising a base, at least two opposing side walls;

a toe wall, and a heel wall;

wherein the base has a first major surface; wherein the at least two opposing side walls extend upwardly from the base and comprise a first wall and a second wall opposite and parallel to the first wall; wherein the toe wall extends upwardly from the base; wherein the heel wall extends upwardly from the base and is opposite and parallel to the toe wall;

allowing each of the first wall, the second wall, the toe wall, and the heel wall to rotate about a hinge attaching each respective wall to the base;

providing a plurality of resistance mechanisms adjustably and releasably attached respectively to each of the first and second walls at a positional height above the base, and respectively to each of the toe wall and the heel wall;

providing a substantially planar, rigid support platform, sized and configured for receiving and supporting a foot of the user thereon, the substantially planar, rigid support platform comprising a toe end, oriented to be closest to the toe wall, and a heel end opposite the toe end, oriented to be closest to the heel wall, wherein at least one of the plurality of resistance mechanisms connects the heel end to the heel wall, wherein a different at least one of the plurality of resistance mechanisms connects the toe end to the toe wall, and wherein another different at least one of the plurality of resistance mechanisms connects to the first wall, the substantially planar, rigid support platform, and the second wall;

positioning the user's foot on the substantially planar, rigid support platform; and instructing the user to move the user's foot to engage and manipulate the user's ankle joint by applying directional pressure to the substantially planar, rigid support platform and engaging at least one of the plurality of resistance mechanisms.

* * * * *